US007275708B2

(12) United States Patent
Lewis et al.

(10) Patent No.: US 7,275,708 B2
(45) Date of Patent: Oct. 2, 2007

(54) DISPENSER FOR ROLLED SHEET MATERIAL

(76) Inventors: Richard Paul Lewis, 3429 Woodrun Trail, Marietta, GA (US) 30062; Paul Francis Tramontina, 155 Cobblestone Way, Alpharetta, GA (US) 30004

( * ) Notice: Subject to any disclaimer, the term of this patent is extended or adjusted under 35 U.S.C. 154(b) by 411 days.

(21) Appl. No.: 10/881,491

(22) Filed: Jun. 30, 2004

(65) Prior Publication Data

US 2006/0000941 A1 Jan. 5, 2006

(51) Int. Cl.
*B65H 16/04* (2006.01)

(52) U.S. Cl. ..... 242/597.8; 206/397; 206/415

(58) Field of Classification Search ..... 242/597, 242/597.2, 597.6, 597.8; 206/397, 408, 415, 206/416; 248/200, 300, 309.2, 316.1; 225/39, 225/42, 46, 48, 49, 80, 106
See application file for complete search history.

(56) References Cited

U.S. PATENT DOCUMENTS

| | | | | |
|---|---|---|---|---|
| 1,322,180 | A | 11/1919 | Crowell | |
| 2,000,454 | A | 5/1935 | Peters | |
| 2,974,850 | A | 3/1961 | Mayer | |
| 3,098,594 | A | 7/1963 | Williamson | |
| 3,667,597 | A | 6/1972 | Hollister | |
| 3,770,172 | A | 11/1973 | Nystrand | |
| 3,981,400 | A * | 9/1976 | Quintana | 206/408 |
| 4,274,573 | A | 6/1981 | Finkelstein | |
| 4,306,687 | A | 12/1981 | Hadtke | |
| 4,756,460 | A | 7/1988 | Ornros | |
| 4,775,109 | A | 10/1988 | Tegg | |
| 5,048,589 | A | 9/1991 | Cook et al. | |
| 5,399,412 | A | 3/1995 | Sudall et al. | |
| 5,402,978 | A * | 4/1995 | Larson | 248/309.2 |
| 5,439,521 | A | 8/1995 | Rao et al. | |
| 5,674,590 | A | 10/1997 | Anderson et al. | |
| 5,743,397 | A | 4/1998 | Traver | |
| 5,772,845 | A | 6/1998 | Farrington, Jr. et al. | |
| 5,816,553 | A * | 10/1998 | Brown | 248/309.2 |
| 5,904,971 | A | 5/1999 | Anderson et al. | |
| 6,241,094 | B1 * | 6/2001 | Anjo et al. | 206/408 |
| 6,248,212 | B1 | 6/2001 | Anderson et al. | |
| 6,273,996 | B1 | 8/2001 | Hollenberg et al. | |
| 6,405,972 | B1 | 6/2002 | Wakam | |
| 6,491,251 | B1 | 12/2002 | Stanland et al. | |
| 6,866,148 | B2 * | 3/2005 | You et al. | 206/408 |

FOREIGN PATENT DOCUMENTS

| | | |
|---|---|---|
| DE | 1946081 A1 | 4/1971 |
| EP | 1352602 A2 | 10/2003 |

* cited by examiner

*Primary Examiner*—William A. Rivera
(74) *Attorney, Agent, or Firm*—Nathan P. Hendon; Richard M. Shane

(57) ABSTRACT

In one embodiment, the apparatus for dispensing rolled sheet material comprises: a roll of sheet material oriented around a roll axis, and a disposable member disposed around the roll. The disposable member comprises a front wall disposed adjacent an end of the roll, a sidewall adjoining the front wall and disposed at a side of the roll, and a connecting member for engaging a wall bracket. A line of weakness is disposed in the sidewall such that a portion of the sidewall can be removed to form an aperture for dispensing the sheet material.

27 Claims, 5 Drawing Sheets

DISPENSER FOR ROLLED SHEET MATERIAL

BACKGROUND

Commercial and consumer absorbent paper products are distributed and dispensed from rolls. Small, i.e., bathroom tissue rolls employed for residential use (e.g., in homes, is about 3 to about 6 inches in diameter) are dispensed by placing a rod through a core of the tissue roll and attaching the roll to a wall dispenser that connects to both ends of the rod. Large or jumbo sized tissue rolls are dispensed in restrooms of commercial buildings and in other locations where high volumes of rolled paper products are needed. These large size rolls generally include a core in the center of the roll. Usually, the rolls are mounted in a dispenser housing.

These large size rolls may not be largely visible to the consumer, as they are often protected in a locked housing which dispenses the paper to its user at its lower margin or edge. Some large roll dispensers include a housing cover that can be removed only with a key to facilitate reloading the dispenser. Other dispensers employ a hinged housing cover that must be opened or moved laterally to facilitate reloading the dispenser. Reloading dispensers is a time consuming task for maintenance personnel.

Both commercial dispensers and home dispensers can become dusty (e.g., from the environment and/or from particles that dislodge from the tissue roll), and dirty (due to contact with hands, moisture, etc.). Additionally, reloading of the dispenser requires direct handling of the tissue roll, which can cause the roll to become dirty and/or damaged. Accordingly, there remains a need for an apparatus for dispensing rolled sheet material that hygienically maintains the tissue roll during shipping, storage, reloading and dispensing.

BRIEF SUMMARY

Disclosed herein are apparatus for dispensing rolled sheet material, holders, and dispensers. In one embodiment, the apparatus for dispensing rolled sheet material includes: a roll of sheet material oriented around a roll axis, and a disposable member disposed around the roll. The disposable member includes a front wall disposed adjacent an end of the roll, a sidewall adjoining the front wall and disposed adjacent a side of the roll, and a connecting member for engaging a wall bracket. A line of weakness is disposed in the sidewall such that a portion of the sidewall can be removed to form an aperture for dispensing the sheet material.

In one embodiment, the holder includes: a connector capable of connecting to a wall such that at least a portion of a second side of the connector contacts the wall, a connector protrusion extending from a first side of the connector, opposite the second side, and, optionally, a plurality of ribs extending from the first side and capable of engaging a plurality of grooves in the connecting member. The connector protrusion can be capable of engaging an indentation in a connecting member of an apparatus for dispensing rolled sheet material such that when the apparatus engages the dispenser, a roll of sheet material can rotate in the apparatus, around the protrusion, and dispense the sheet material.

In one embodiment, the dispenser includes: a connector and a mounting bracket. The connector is capable of connecting the mounting bracket to a wall such that at least a portion of a second side of the connector contacts the wall.

The mounting bracket extends from a first side of the connector, opposite the second side, and the mounting bracket is capable of engaging a connecting member of an apparatus for dispensing rolled sheet material, wherein, when engaged, the mounting bracket extends through the connecting member and contacts an inner surface of the connecting member.

In yet another embodiment, the disposable apparatus for dispensing rolled sheet material includes a roll of sheet material oriented around a roll axis and a disposable member disposed around the roll, wherein the disposable apparatus has sufficient structural integrity to contain and dispense the rolled sheet material while engaging at least one of a wall and a mounting bracket attached to the wall. The disposable member includes a front wall disposed adjacent an end of the roll, a sidewall adjoining the front wall and disposed adjacent a side of the roll, and a connecting member. A line of weakness is disposed in the sidewall such that a portion of the sidewall can be removed to form an aperture for dispensing the sheet material.

The above described and other features are exemplified by the following figures and detailed description.

BRIEF DESCRIPTION OF DRAWINGS

Refer now to the figures, which are exemplary, not limiting, and wherein like elements are numbered alike in the several figures and, as such may not be discussed in relation to each figure.

DETAILED DESSCRIPTION

Disclosed herein is an apparatus for dispensing rolled sheet material comprising a roll of sheet material and a disposable member disposed around the roll of sheet material. The apparatus further comprises a connecting member for engaging a wall bracket. Also, disclosed herein is a dispenser comprising a connector capable of connecting the dispenser to a wall (e.g., a vertical surface such as a bathroom stall wall, a door, a building wall, or the like) and a protrusion capable of engaging a connecting member of an apparatus for dispensing rolled sheet material. The roll of sheet material can rotate in the apparatus, around the protrusion, and dispense the sheet material.

The apparatus can be employed to dispense any rolled sheet material desirably rolled paper material. Exemplary sheet materials include, but are not limited to, absorbent sheet materials such as towels, wipes, tissue, and so forth. Suitable sheet materials are disclosed, by way of non-limiting examples only, in U.S. Pat. No. 5,048,589 to Cook et al., U.S. Pat. No. 5,399,412 to Sudall et al., U.S. Pat. No. 5,674,590 to Anderson et al., U.S. Pat. No. 5,772,845 to Farrington, Jr. et al., U.S. Pat. No. 5,904,971 to Anderson et al., U.S. Pat. No. 6,248,212 to Anderson et al., and U.S. Pat.

No. 6,273,996 to Hollenberg et al. The sheet materials are rolled, e.g., around a core, or without a core. Optionally, the sheet materials can have regularly spaced zones of weakness extending substantially across the width of the sheet material. The zones of weakness can be used to facilitate separate of the sheet material into individual sheets and may be, for example, defined by a series of perforations. In one embodiment, the sheet material having regularly spaced zones of weakness substantially extending across its width can be double wound into a roll having inner and outer layers of sheet material wherein the zones of weakness for the inner and outer layers are offset, for example, as is taught in U.S. Pat. No. 3,770,172 to Nystrand. Double-wound layers having offset zones of weakness allow the sheet material to tear within the dispenser while still providing a tail of sheet material extending from the dispenser to be grasped by the next patron.

The size of the roll of sheet material is merely dependent upon the application, e.g., commercial or residential. The rolls can be any size, e.g., about 3 inches in diameter to about 18 inches in diameter; such as a single roll (e.g., about 3 inches to about 4 inches), a double roll (e.g., about 4 inches to about 5 inches), or a jumbo roll (e.g., about 10 inches to about 16 inches). Jumbo roll products have a relatively large diameter and are used in high traffic areas, such as public restrooms and the like. In one embodiment, the roll of sheet material has a diameter of about 8 to about 15 inches, or, more specifically has a diameter of about 9 to about 12 inches, measured along major axis.

Figure 1:
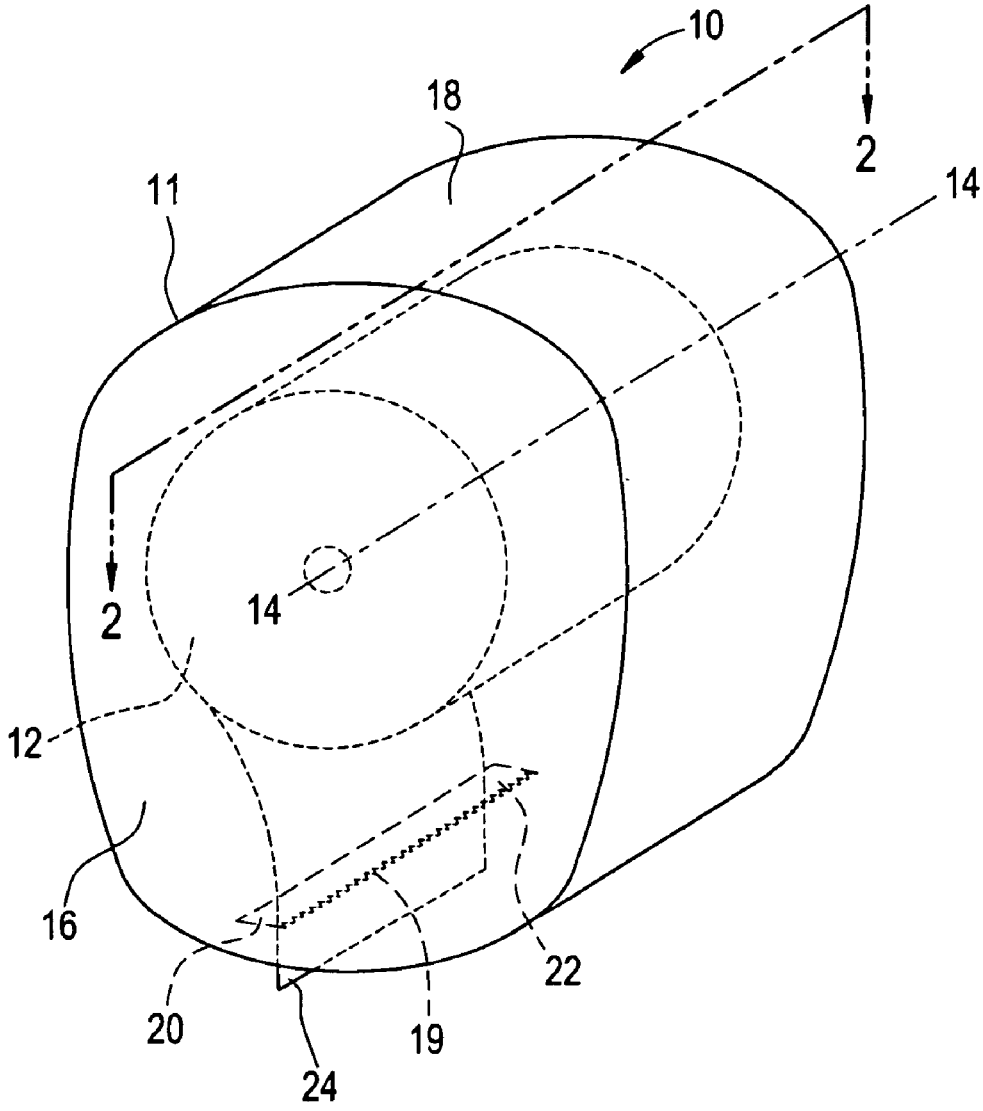
FIG. 1 is a perspective view of one embodiment of an apparatus for dispensing rolled sheet material.
Figure 2:
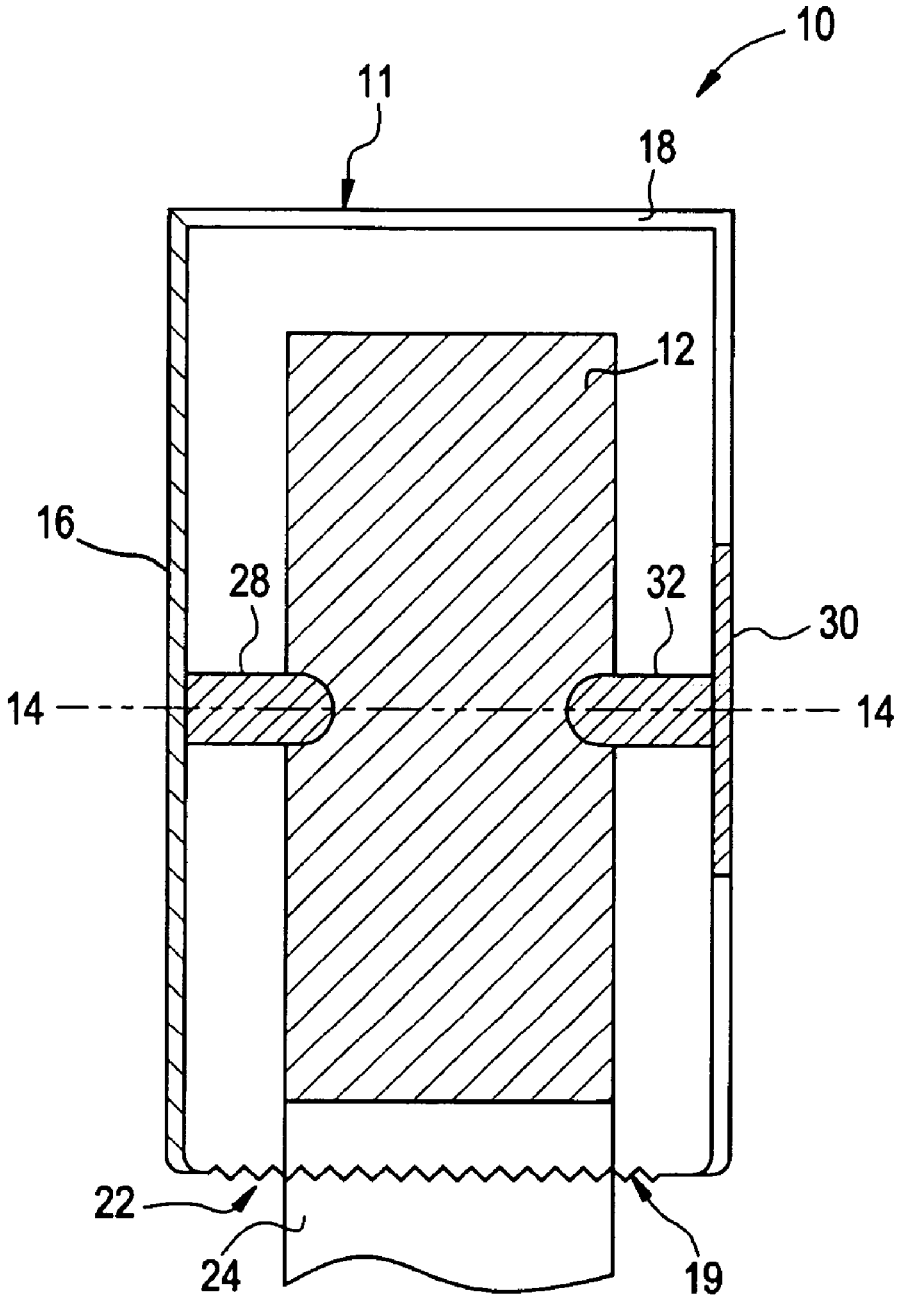
FIG. 2 is a cross-sectional view of the apparatus of FIG. 1 taken along line 2-2.

Referring now to FIGS. 1 and 2, an apparatus 10 for dispensing rolled sheet material is shown. The apparatus 10 comprises a disposable member 11 disposed around a roll of sheet material 12. The disposable member 11 is a housing around a rolled sheet material that can be attached to a wall, dispense the rolled sheet material, be removed from the wall, and be disposed. Although it is envisioned that the disposable member 11 can be refillable, a non-refillable, single use dispenser enhances hygiene and cleanliness of the sheet material, as well as protection of the sheet material from damage during shipping and/or storage.

The roll 12 of sheet material disposed in the disposable member is oriented around a roll axis 14. The disposable member 11 comprises a front wall 16 disposed on an end of the roll 12 and a sidewall 18 adjoining the front wall 16 and disposed at a side of the roll 12. A line of weakness 20 is disposed in the sidewall 18 such that a portion of the sidewall 18 can be removed to form an aperture 22 for dispensing the sheet material. Sheet material tail 24 can be available to the user through the aperture 22. Optional serrated edge 19 can be formed from a side of the aperture 22 to facilitate separation of portions of the sheet material from the roll.

The disposable member 11 comprises a connecting member 30 for engaging a wall bracket such that the front wall 16 will be disposed on a side of the roll 12 opposite the wall bracket. In one embodiment, the line of weakness 20 is disposed in an area of the sidewall 18 such that, when the connecting member 30 engages the wall bracket, the line of weakness 20 is disposed within a lower part of the sidewall 18, or, more specifically disposed within a bottom eighth of the sidewall 18.

The size, shape, and configuration of the disposable member 11 are sufficient to contain the desired roll of sheet material, and may take on any aesthetic design. For example, the shape can be rounded or polygonal, e.g., a closed cylindrical shape (e.g., a round cross-section, oval cross-section, or the like), a closed hexagonal shape, and the like. Additionally, aesthetic decorations and/or designs; product, manufacturer, and/or source identifiers; and the like, can be disposed on one or more surfaces of the disposable member 11, e.g., on the front wall and/or on the sidewall. To enhance the cleanliness of the sheet material, it can be sealed within the disposable member 11 such that the disposable member 11 inhibits dirt, dust, and other contaminants from contacting the sheet material during transport, sale, and installation for use. In one embodiment, the sidewall 18 is substantially cylindrical in shape.

The disposable member may also comprise any suitable material, e.g., a material providing sufficient structural integrity to enable the disposable member 11 to connect to a wall bracket and enable the dispensing of the sheet material 12 from the disposable member 11. The disposable member can comprise materials suitable for forming and containing (e.g., forming the dispenser housing and containing the sheet material), and possessing sufficient structural integrity to dispense the rolled sheet material while attached to a wall. It is understood that a combination of materials can be employed such that higher stress areas (e.g., the area of the dispenser that connects to the wall) comprises a material having greater structural integrity than other portions of the disposable member (e.g., the front wall). Some possible materials include plastics, pressed paper, and the like, e.g., thermoformed plastic.

Figure 3:
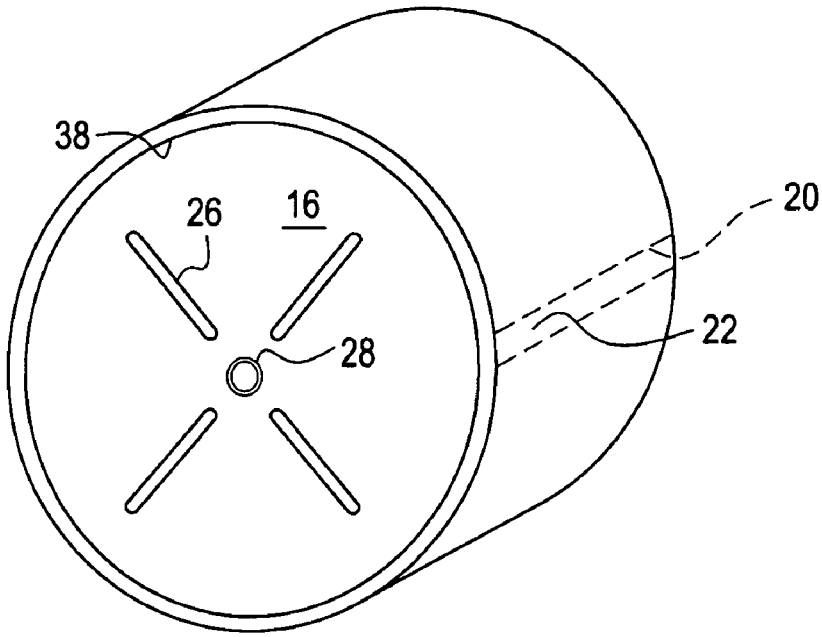
FIG. 3 is a perspective front view of another embodiment of an apparatus for dispensing rolled sheet material.

The front wall 16 can comprise various designs, e.g., for aesthetics, structural purposes, and/or for simplicity in shipping and storage. The desired structural features of the front wall 16 are dependent upon the size and type of the rolled sheet material (e.g., coreless or with a core). Possible structural features include rib(s), protrusion(s), groove(s), lip(s), shelve(s), and the like, as well as combinations comprising at least one of the foregoing features. For example, referring to FIGS. 2 and 3, the front wall 16 can comprise a front protrusion 28 that can engage the roll 12, a plurality of front ribs 26 for structural integrity, and a front groove 38 disposed about the periphery of the front wall 12. The front groove 38 can enable facile stacking of a plurality of apparatus 10 for shipping and/or storage.

As discussed above, the connecting member 30 is capable of engaging a mounting bracket such that the disposable member 11 can be mounted to a wall. The design and size of the connecting member 30 is dependent upon the size of the rolled paper, the type of rolled paper (e.g., coreless or with a core), and the design of the mounting bracket. In one embodiment that is particularly useful with coreless materials, the connecting member 30 comprises a back protrusion 32 that protrudes toward and engages the roll 12 on a side opposite the front protrusion 28 such that the roll can rotate around the front protrusion 28 and the back protrusion 32 to dispense the sheet material through the aperture 22, as shown in FIG. 2. The protrusion 32 forms an indentation on a side of the connecting member opposite the roll 12.

Figure 4:
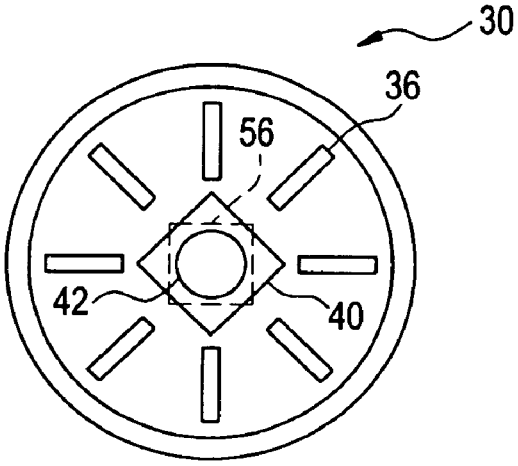
FIG. 4 is a front view of one embodiment of a connector.

Referring to FIG. 4, the connecting member 30 can optionally comprise a plurality of back ridge(s) protruding toward the roll 12 and forming a plurality of grooves 36 on a side of the connecting member 30 opposite the roll 12. The back ridges can provide structural integrity to the connecting member and are disposed so as to add strength as desired. Optionally, the back ridge(s) can be disposed radially around the connecting member 30, as shown in FIG. 4.

The connecting member 30 can engage a mounting bracket in many different fashions, including via the use of a polyhedral mounting hole 40 capable of receiving a mounting bracket. In one embodiment, the mounting hole 40 can be formed by lines of weakness (e.g., scores or the like)

that can enable removal of a portion of the connecting member 30 to form the mounting hole 40. Additionally, to facilitate formation of the mounting hole 40, hole scores 42 can be disposed within the lines of weakness to enable one or more fingers (or an instrument) to engage the removable portion of the connecting member 30 such that the area of material forming the mounting hole 40 can be pulled from the connecting member 30.

Figure 5:
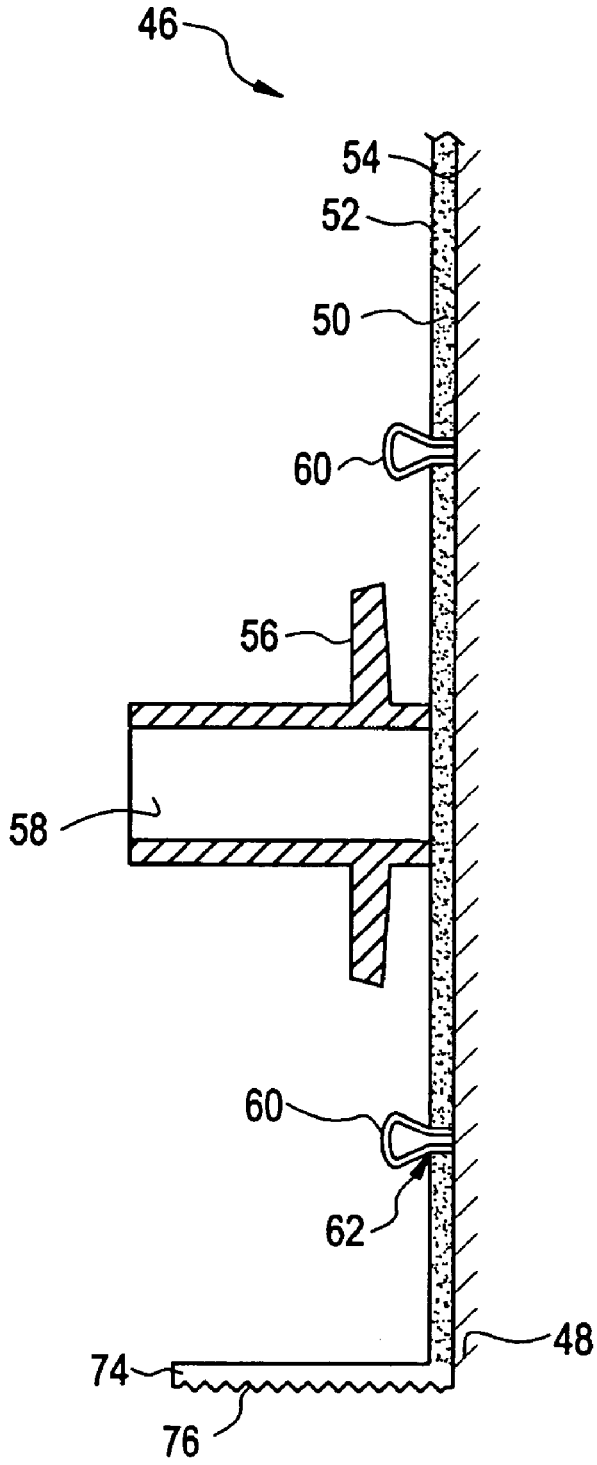
FIG. 5 is a front view of one embodiment of a mounting bracket.

In one embodiment, a holder 46 comprises a connector 50 and a mounting bracket 56 comprising a hub 58, as shown in FIG. 5. The connector 50 is capable of connecting the holder 46 to a wall 48 such that at least a portion of a second side 54 of the holder 46 contacts the wall 48. The mounting bracket extends from a first side 52 of the holder 46, opposite the second side 54. The hub 58 can protrude from the first side 52 at an angle perpendicular to the wall 48, such that the roll axis 14 (see FIG. 1) will extend outward, away from the wall, e.g., be perpendicular to the wall 48, when the apparatus 10 is disposed on the holder 46.

To simplify attachment of the apparatus 10 to the holder 46, the mounting hole 40 can have a geometry capable of receiving the mounting bracket 56, and a size larger than the mounting bracket 56. For example, a square mounting hole 40 can receive a round hub 58 with the mounting bracket 56 disposed near the end of the hub 58. The hub 58 is inserted through the mounting hole 40 and into the core of the roll 12 a sufficient distance such that the mounting bracket 56 passes through the mounting hole 40. Once the mounting bracket 56 passes through the mounting hole 40, relative motion between the mounting bracket 56 and the disposable member 11 (e.g., a rotation of about 45 degrees), causes sides of the mounting bracket 56 to engage the connecting member 30 (see the mounting bracket 56 in FIG. 4). The mounting bracket protrudes though the connecting member 30, into the disposable member 11, and engages an interior wall of the connecting member 30.

When the hub 58 and mounting bracket 56 are disposed through the mounting hole 40, the hub extends from the mounting bracket through at least a portion of the roll 12 along the roll axis 14. The distance that the hub extends into the core of the roll 12, along the roll axis 14, is sufficient to provide structural integrity to the mounted apparatus such that the rolled sheet material 12 can be dispensed without dislodging the apparatus 10 from the holder 46. For example, the hub 58 can extend greater than or equal to about half way through the roll, or, more specifically, greater than or equal to about $2/3^{rds}$ of the way through the roll, and, even more specifically, greater than or equal to about $3/4^{ths}$ of the way through the roll. In order to avoid friction, wear, and/or damage to the front wall 16, the hub 58 can extend all the way through the roll 12, yet be disposed in a spaced relationship with the front wall 16.

The connector 50 is mountable to a wall, divider (e.g., stall divider in a public restroom), or the like, using any method capable of securely attaching the connector 50 to the wall such that an apparatus 10 can be attached to the holder 46. For example, the connector 50 can comprise mounting hole(s) 62 with mounting element(s) 60 to secure holder 46 to the wall 48. Some possible mounting elements include screw(s), nail(s), rivet(s), bolt(s), and the like. Alternatively or in addition, an adhesive can be disposed between the second side 54 of the holder 46 and the wall 48 to bond the holder 46 to the wall 48.

To facilitate dispensing of the sheet material, the holder 46 optionally further comprises a tear bar 74 protruding from the first side 52 of the holder 46, e.g., substantially perpendicular to the wall 48. When the apparatus 10 is engaged with the holder 46, the tear bar 74 aligns with the aperture 22. Optionally, the tear bar 74 can have a serrated edge 76 on a side distal from the sidewall 18 of the disposable member 11.

Figure 6:
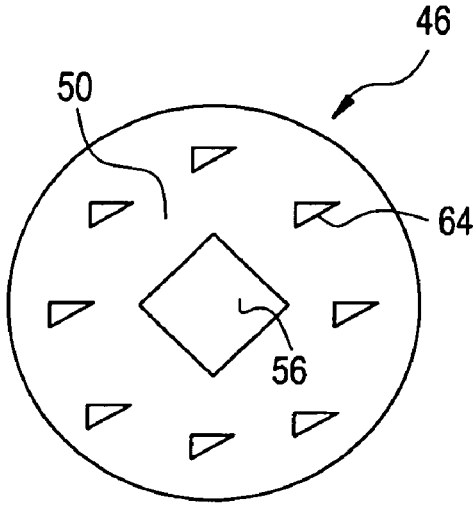
FIG. 6 is a side, cross sectional view of a one embodiment of a holder.

To enhance the structural integrity of the holder 46, and optionally to facilitate alignment of an apparatus 10 on the holder 46, the connector 50 can comprise bracket rib(s) 64, as shown in FIG. 6. The ribs 64 can be disposed radially about the connector 50. Optionally, the ribs 64 can engage the grooves 36, when the apparatus 10 engages the holder 46.

Figure 7:
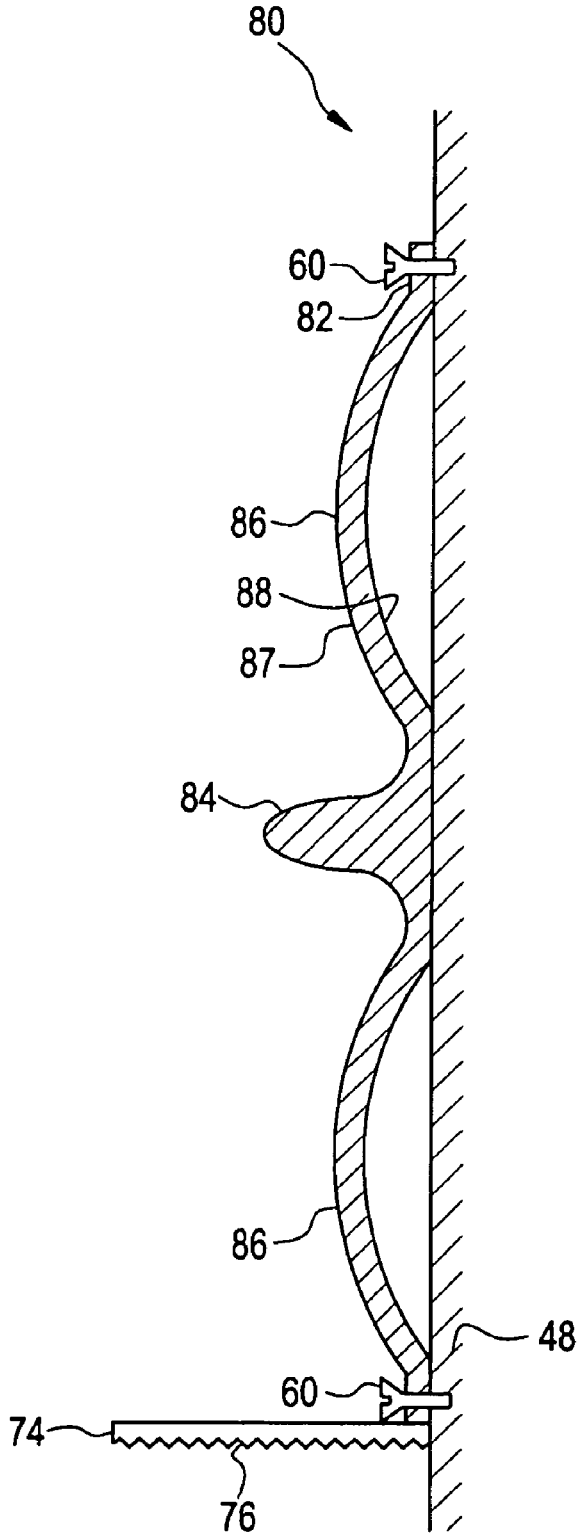
FIG. 7 is a perspective view of a dispenser in accordance with one embodiment of the disclosure.

In another embodiment, a holder 80 comprises a connector 82, a connector protrusion 84, and a plurality of connector ribs 86, as shown in FIG. 7. The connector 82 is capable of connecting the holder 80 to a wall 48 such that at least a portion of the second side 88 of the holder 80 contacts the wall 48. The connector protrusion 84 extends from a first side 87 of the holder 80, away from the second side 88 and the wall 48. The protrusion 84 is capable of engaging an indentation (formed by protrusion 32) in a connecting member 30, e.g., near a center of the connecting member 30 (see also FIG. 2). The dispenser rib(s) 86 can extend radially from the first side 87 of the holder 80, and can be oriented and designed to engage a plurality of grooves in the connecting member 30 (see also FIG. 4).

The disposable member and the holder are designed such that the disposable member 11 can be removably mounted on the holder 46/80 such that the connecting member 30 engages the hub 58 and mounting bracket 56 (e.g., if the roll 12 has a core), or the connector protrusion 84 (e.g., if the roll 12 is coreless). For alignment and structural integrity, the connector ribs 86 can engage grooves 36 to secure the disposable member 11 to the holder 46.

Transportation and storage of rolled sheet material (e.g., paper towels, bathroom tissue, and the like), can damage the sheet material. Additionally, the handling of the material during the transportation, storage, and installation in a holder can damage the material and/or contaminate the material with dirt, dust, germs, and the like. Disposal of the rolled sheet material in a disposable member as disclosed herein, however, can enable facile stacking and storage of the rolled sheet material, as well as dispensing of clean, hygienic material from a holder. Since the material can be sealed within the disposable member for transportation, storage, and installation in a holder, the material can remain clean and hygienic. The use of lines of weakness (e.g., scores) can enable an aperture to be formed in the disposable member prior to or after installation on a holder to allow dispensing of the rolled sheet material. Optionally, additional lines of weakness and/or holes can be disposed in the disposable member to enable facile formation of the aperture and/or facile carrying of the disposable member. Handling and carrying can also be facilitated with an optional handle, finger hold, peripheral ridge, and/or the like.

It is further noted that, although the disposable member is discussed in relation to a single roll of sheet material, it is understood that the disposable member could contain more than one roll of sheet material. In this embodiment, the disposable member could have an elongated geometry such that the subsequent roll of sheet material is disposed above the first roll of sheet material when the disposable member engages the wall and when the first roll of sheet material is being dispensed. Upon dispensing the entire first roll of sheet material, the second roll of sheet material would move (manually or automatically) toward the aperture in order to be dispensed.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Thereof, it is intended that the disclosure not be limited to the particular embodiment disclosed as the best mode contemplated for carrying out this disclosure, but that the disclosure will include all embodiments falling within the scope of the appended claims.

We claim:

1. A dispenser, comprising:

an apparatus for dispensing rolled sheet material;

a connector; and a mounting bracket;

wherein the apparatus comprises a front wall, a sidewall adjoining the front wall, and a connecting member for engaging a wall bracket, wherein the connector is capable of connecting the mounting bracket to a wall such that at least a portion of a second side of the connector contacts the wall; and wherein the mounting bracket extends from a first side of the connector, opposite the second side;

wherein the mounting bracket is configured to engage the connecting member of the apparatus for dispensing rolled sheet material, wherein, when engaged, the mounting bracket extends through the connecting member and contacts an inner surface of the connecting member.

2. The dispenser of claim 1, further comprising a roll of sheet material oriented around a roll axis;

wherein the front wall, the side wall, and the connecting member cooperate to provide a disposable member disposed around the roll, wherein the front wall is disposed adjacent an end of the roll, wherein the sidewall is disposed at a side of the roll, wherein a line of weakness is disposed in the sidewall such that a portion of the sidewall can be removed to form an aperture for dispensing the sheet material, and wherein the connecting member is configured to engage the mounting bracket such that the front wall will be disposed adjacent the end of the roll opposite the connecting member.

3. The dispenser of claim 1, wherein the roll has a diameter of about 8 inches to about 15 inches, measured along a major axis.

4. The dispenser of claim 1, wherein the sidewall is substantially cylindrical.

5. The dispenser of claim 4, wherein the line of weakness is disposed in an area of the sidewall such that, when the connecting member engages the mounting bracket, the line of weakness will be disposed within a bottom eighth of the sidewall.

6. The dispenser of claim 1, wherein, when the connecting member engages the mounting bracket, the roll axis is disposed perpendicular to the wall.

7. The dispenser of claim 1, wherein the front wall comprises a plurality of front ridges protruding toward the roll.

8. The dispenser of claim 7, wherein the front ridges are disposed radially about the front wall.

9. The dispenser of claim 1, wherein the front wall comprises a front protrusion that engages the roll such that the roll can rotate around the front protrusion to dispense the sheet material through the aperture.

10. The dispenser of claim 1, wherein the connecting member further comprises a plurality of back ridges protruding toward the roll.

11. The dispenser of claim 10, wherein the back ridges form a plurality of grooves on a side of the connecting member opposite the roll.

12. The dispenser of claim 10, wherein the back ridges are disposed radially about the connecting member.

13. The dispenser of claim 1, wherein the connecting member comprises a back protrusion that engages the roll such that the roll can rotate around the back protrusion to dispense the sheet material through the aperture.

14. The dispenser of claim 1, wherein the roll is sealed within the disposable member.

15. The dispenser of claim 1, wherein the connecting member defines a polyhedral mounting hole capable of receiving the mounting bracket, wherein when the connecting member engages the mounting bracket, the mounting bracket protrudes through the connecting member, into the disposable member, and engages an interior wall of the connecting member.

16. The dispenser of claim 15, wherein the mounting hole and roll are capable of receiving a hub such that when the disposable member engages the mounting bracket, the hub extends from the mounting bracket through at least a portion of the roll, along the roll axis.

17. The dispenser of claim 1, wherein the front wall further comprises a step capable of engaging an adjacent connector of an adjacent apparatus in a stack.

18. The dispenser of claim 17, wherein the step is a groove disposed coaxially around the front wall.

19. The dispenser of claim 1, wherein the disposable member is a thermoformed plastic.

20. The dispenser of claim 1, wherein the apparatus further comprises a subsequent roll of sheet material, wherein the subsequent roll of sheet material is disposed above the roll of sheet material when the apparatus engages the mounting bracket such that the subsequent roll of sheet material can be dispensed after the roll of sheet material.

21. The dispenser of claim 1, wherein the mounting bracket further comprises a hub that protrudes from the first side, and when the mounting bracket engages the connecting member, the hub extends into a roll of sheet material disposed in the apparatus, along a roll axis.

22. The dispenser of claim 1, further comprising a plurality of ribs extending from the first side, the ribs oriented and designed to engage a plurality of grooves in the connecting member.

23. The dispenser of claim 22, wherein the plurality of ribs extend radially.

24. The dispenser of claim 1, further comprising a tear bar protruding from the first side such that, when the apparatus engages the dispenser, the tear bar is aligned with an aperture in the apparatus through which the sheet material can be dispensed.

25. A dispenser, comprising:

a holder comprising a connector; and a mounting bracket;

wherein the connector is capable of connecting the mounting bracket to a wall such that at least a portion of a second side of the connector contacts the wall; and wherein the mounting bracket extends from a first side of the connector, opposite the second side;

a roll of sheet material oriented around a roll axis; and a disposable member disposed around the roll, wherein the disposable member comprises a front wall disposed adjacent an end of the roll, a sidewall adjoining the front wall and disposed adjacent a side of the roll, wherein a line of weakness is disposed in the sidewall such that a portion of the sidewall can be removed to form an aperture for dispensing the sheet material, and a connecting member engaging the mounting bracket.

26. The dispenser of claim 25, wherein the connecting member further comprises a polyhedral hole; and wherein the mounting bracket further comprises a polyhedral portion extending from the first side through the polyhedral hole, and contacts an inner surface of the connecting member.

27. The dispenser of claim 25, wherein the holder further comprises a tear bar protruding from the first side and aligned with the aperture.

* * * * *